US006569042B2

(12) United States Patent
LaChance et al.

(10) Patent No.: US 6,569,042 B2
(45) Date of Patent: May 27, 2003

(54) SPORTS SWING DEVELOPMENT DEVICE

(76) Inventors: James L. LaChance, 21701 Sherwood, Belleville, MI (US) 48111; Edward M. Collins, 10031 Mortenview, Taylor, MI (US) 48180

( * ) Notice: Subject to any disclaimer, the term of this patent is extended or adjusted under 35 U.S.C. 154(b) by 0 days.

(21) Appl. No.: 09/759,882

(22) Filed: Jan. 16, 2001

(65) Prior Publication Data

US 2002/0094888 A1 Jul. 18, 2002

(51) Int. Cl.[7] ..... A63B 69/00; A63B 59/00; A63B 59/18; A63B 59/06

(52) U.S. Cl. ..... 473/457; 473/519; 473/564; 473/453

(58) Field of Search ..... 473/219, 221, 473/222, 223, 226, 233, 256, 234, 415, 422, 451, 453, 463, 457, 519, 559, 564–568; 482/109, 909; 73/492, 493; 446/418, 421

(56) References Cited

U.S. PATENT DOCUMENTS 537,927 A * 4/1895 Kennedy ..... 473/520
2,780,098 A * 2/1957 Maroth ..... 473/233
3,116,926 A * 1/1964 Owen et al. ..... 473/457
3,136,546 A * 6/1964 Connolly ..... 473/234
3,414,260 A * 12/1968 Gust ..... 473/256
3,561,272 A * 2/1971 Davis ..... 473/233
3,679,205 A * 7/1972 Finkle et al. ..... 473/232
4,267,793 A * 5/1981 Lane et al. ..... 473/453
4,399,996 A 8/1983 Boyce ..... 69/40
4,555,111 A 11/1985 Alvarez ..... 69/40
4,871,168 A * 10/1989 Autorino et al. ..... 473/453
5,014,984 A 5/1991 Brockhoff ..... 69/40
5,516,097 A * 5/1996 Huddleston ..... 473/457
6,173,610 B1 * 1/2001 Pace ..... 473/233
6,280,353 B1 * 8/2001 Brundage ..... 473/457

* cited by examiner

*Primary Examiner*—Paul T. Sewell
*Assistant Examiner*—Mitra Aryanpour
(74) *Attorney, Agent, or Firm*—Charles W. Chandler

(57) ABSTRACT

A practice batting device having an elongated gripping portion and an elongated weighted portion interconnected with a spring. A swing speed indicator is positioned within the elongated weighted portion to determine the swing speed of the device. Removable plates permit a selected practice weight, thereby targeting strength training for eliminating recoil effects and snapping the user's wrists to simulate the impact of the bat striking an imaginary ball.

8 Claims, 2 Drawing Sheets

SPORTS SWING DEVELOPMENT DEVICE

TECHNICAL FIELD

The present invention relates generally to sports swing development devices and more specifically, to a practice batting device capable of indicating swing speed and simulating the counter force and motion of an object at contact. The present invention is particularly useful in, although not strictly limited to, batting applications targeting strength training and an accurate indication thereof.

BACKGROUND OF THE INVENTION

The ability to drive a ball a long distance is the basis for success in a variety of sports. As the dynamics of sports equipment have improved, so has player performance. Records continue to be broken in baseball, softball, golf and other sports wherein new bats, clubs and mallets enable superior swing-play execution.

Whether working to fully realize the dynamic benefits of a technologically advanced golf club or trying to maximize the performance of a simple wooden bat, players strive to develop and perfect their swing. To assist in this development, swing simulating practice devices are utilized. The simplest of these involves adding weights to a practice device, such as a bat, to enhance warm-up motion and to build strength.

Other practice devices are designed to assist a player in breaking his or her wrists to develop a snap to the stroke at impact resulting in maximized acceleration. One such device is described in U.S. Pat. No. 4,399,996 to Boyce wherein the handle and the head of a practice bat are connected with a spring. In use, a player positions one hand below the spring on the handle, and the other hand above the spring on the head of the bat. The device teaches a tactile sensation when swung by a batter, wherein the upper hand overruns the lower hand, imparting a leverage and acceleration to the impact portion of the bat. While this device may assist a batter in breaking his wrists, it does not effectively simulate the counter force and motion of the ball at contact. Furthermore, it does not provide a means of directly validating swing improvement. Thus, in light of the present invention, the practice bat of Boyce is disadvantageous.

An alternative practice device, described in U.S. Pat. No. 5,014,984 to Brockhoff, utilizes gripping points to assist a batter with proper wrist rotation. This device is specifically designed to address the batter wrist rotation element of a swing, not to improve the batter's strength and swing speed. As such, the Brockhoff device is disadvantageous.

U.S. Pat. No. 4,555,111 to Alvarez describes a practice bat having a weighted end portion interconnected by a resilient spring. The device is directed to warm up a batter, and to aid a player in breaking his or her wrists to achieve a maximum stroke. Alvarez teaches that during the practice swing, momentum will cause the weighted end portion of the device to pivot or flex backward, and then forward thereby influencing the movement of the batter's hands and arms causing the wrists to break ahead of the bat. Thus, like the Boyce practice bat, the Alvarez bat may assist a batter in breaking his wrist, but does not target improvement of batter strength or swing speed.

Furthermore, while Alvarez provides weighted end portions of different weights or sizes dependant upon the size and strength of the person using the practice bat, it does not allow for graduated weight adjustment during training. Even if the weighted end portions of Alvarez were adequate, the bat provides no method for tracking or improving swing performance. Thus, in view of the present invention, the Alvarez bat is disadvantageous.

Therefore, it is readily apparent that there is a need for a weight adjustable swing development practice bat wherein swing speed is indicated and the negative weight and motion of an object at contact is simulated thereby improving batter strength and swing speed.

BRIEF SUMMARY OF THE INVENTION

The present invention overcomes the above-mentioned disadvantages, and meets the recognized need for such a practice bat, by providing an adjustable weight batting device capable of indicating swing speed and simulating the negative weight and motion of an object at contact thereby targeting strength training for elimination of recoil effects.

According to its major aspects, the present invention is a bat having two flexibly-linked elongated portions, a readable speed gauge and removable weighted plates. More specifically, the present invention is a bat wherein an elongated gripping portion and an elongated weighted portion are interconnected with a spring. A speed gauge is positioned within the weighted portion to determine the swing speed of the device and to provide a visual readout. Removable weight plates are positioned at the proximate end of the weighted portion. Each plate is centrally secured to a threaded shaft.

A feature and advantage of the present invention is the ability of such a practice bat to indicate swing speed thereby validating improvements. A speed gage can be either built in the bat or added on the bat.

A feature and advantage of the present invention is the ability of such a device to simulate the counter force and motion of a moving ball at contact.

A feature and advantage of the present invention is the ability of such a practice bat to target strength training for eliminating recoil effects.

A feature and advantage of the present invention is the ability of such a practice bat to cause the batter's wrists to snap, simulating the impact of the bat on an imaginary ball.

A feature and advantage of the present invention is the ability of such a practice device to improve swing speed.

A feature and advantage of the present invention is the ability of such a device to assist in assessing appropriate bat weight for maximized speed and impact energy by combining a swing speed indicator and adjustable bat weight.

These and other objects, features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternative Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

In describing the preferred and alternative embodiments of the present invention, as illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
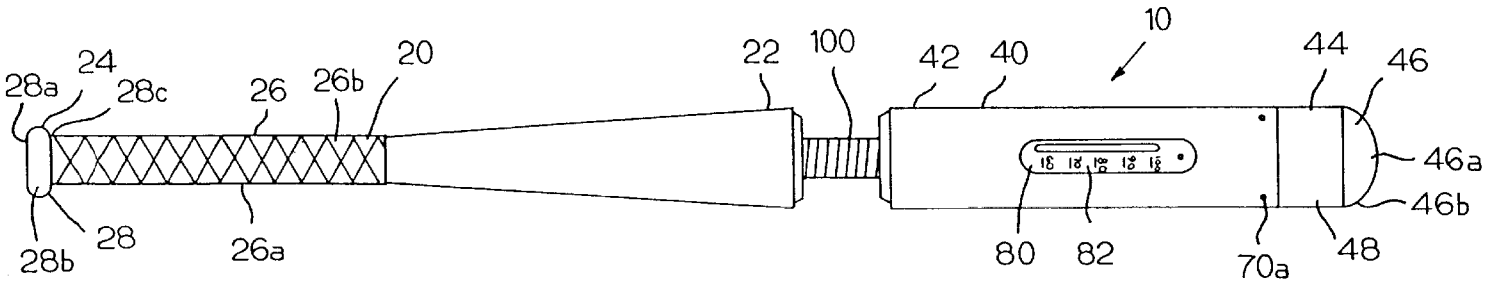
FIG. 1 is a perspective view of a practice bat according to a preferred embodiment of the present invention.

Referring now to FIG. 1, the present invention is a practice bat 10 comprising elongated gripping portion 20 and elongated weighted portion 40 connected by spring 100. Elongated gripping portion 20 and elongated weighted portion 40 have proximal ends 22 and 42, respectively, and distal ends 24 and 44, respectively. Spring 100 is positioned between proximal ends 22 and 42.

Elongated gripping portion 20 is substantially cylindrically-shaped. The circumference of elongated gripping portion 20 is greatest at proximal end 22 and decreases gradually to gripping region 26 where the circumference is substantially constant. Base portion 28 is preferably positioned on distal end 24 adjacent gripping region 26. Base portion 28 has a substantially flat, bottom surface 28*a*. Surrounding surface 28*b* extends therefrom to a flat, annular inner surface 28*c* attached to gripping region 26. Outer surface 26*a* of gripping region 26 is substantially covered with a grip-enhancement material 26*b* such as, for exemplary purposes only, rubberized gripping mesh, sports grip tape or any other known gripping material.

Elongated weighted portion 40 is substantially cylindrically-shaped. Removable cap 46 is rubberized and is positioned on distal end 44. Cap 46 has a flat top surface 46*a*, and a curved surrounding surface 46*b* extending to a removable cylinder 48. Cylinder 48 is positioned on distal end 44 secured by cap 46.

Figure 2:
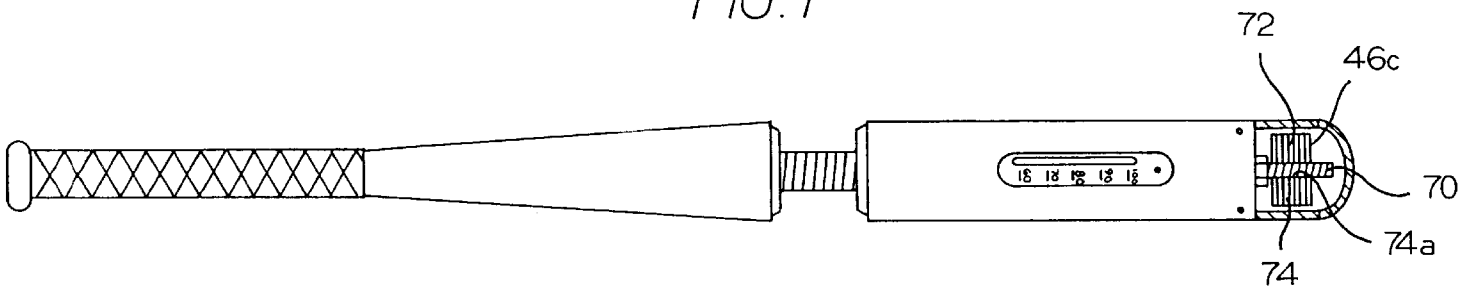
FIG. 2 is a partial cross-sectional view of the practice bat of FIG. 1 showing an internal arrangement of adjustable weights.

Referring to FIG. 2, inner surface 46*c* of cap 46 is threaded to receive and secure a threaded male member 70. Preferably, male member 70 is positioned axially within distal end 44 secured to cap 46. Fastening members 70*a* are radially positioned within elongated weighted portion 40 adjacent distal end 44, to secure male member 70.

A plurality of weighted plates 72 are removably positioned within cylinder 48 adjacent distal end 44. Plates 72 are substantially flat, circular-shaped discs 74 having a threaded central opening 74*a*, whereby plates 72 are removably secured to male member 70.

Preferably, readable speed gauge 80 is positioned within elongated weighted portion 40 with readable surface 82 wherein the swing speed of device 10 is measured and indicated. Gauge 80 is known in the art and is preferably mechanical. One skilled in the art would readily recognize that, while a mechanical speed gauge is preferred, an electronic or computerized speed gauge could be utilized to perform substantially the same function without substantially affecting the inventive concept of the present invention.

Figure 3:
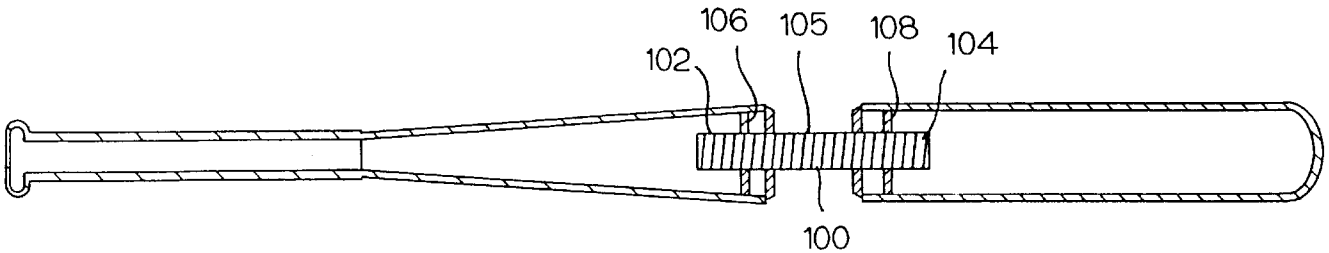
FIG. 3 is a partial cross-sectional view of the practice bat of FIG. 1 showing an internal spring anchoring structure.

Referring to FIG. 3, coil spring 100 has first end 102, second end 104 and center portion 105. First end 102 is axially positioned within proximal end 22 of elongated portion 20. Second end 104 is axially positioned within proximal end 42 of elongated portion 40. Center portion 105 is positioned between elongated gripping portion 20 and elongated weighted portion 40, permitting elongated weighted portion 40 to pivot relative to elongated gripping portion 20. Fastening member 106 is positioned within elongated portion 20 adjacent proximal end 22, passing through and securing end 102 of spring 100 to end 22. Fastening member 108 is preferably positioned within elongated portion 40 adjacent proximal end 42, passing through and securing second end 104 of spring 100 to proximal end 42.

In an alternative embodiment, practice bat 10 could be a golf club instead of a bat.

In yet another embodiment, outer surface 26*a* of gripping region 26 could be formed with a grip-enhancing texture.

In still another embodiment, bat 10 could be formed without removable weighted plates.

In yet still another embodiment, practice bat 10 could be formed without readable speed gauge 80.

Speed gauge 80 could be computerized for recording and analyzing swing speed measurements.

In use, cylinder 48 is removed from elongated weighted portion 40 of practice bat 10 and a selected number of weighted plates 72 are secured to male member 70 with cap 46. The number of weighted plates 72 determines the swinging weight of bat 10.

Figure 4:
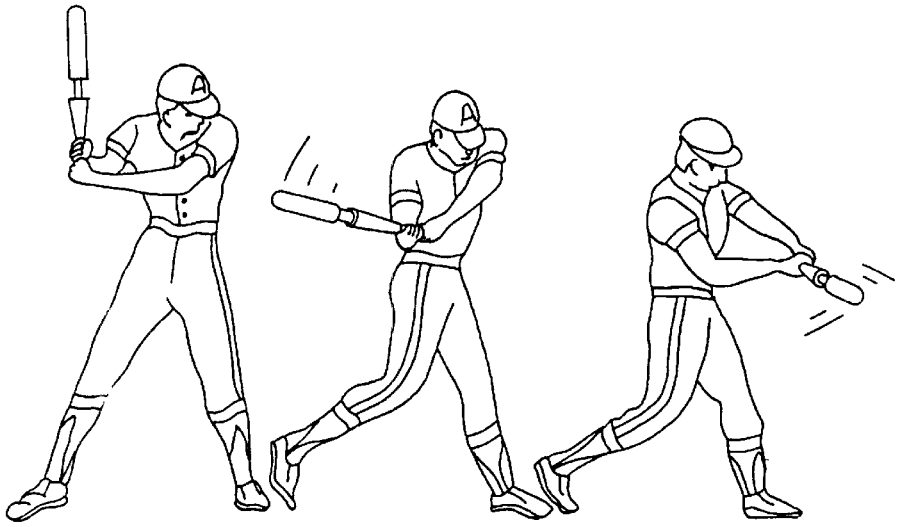
FIG. 4 is a perspective view of a practice bat of FIG. 1 shown in use for strength building.

As best seen in FIG. 4, to build wrist strength, a player places his hands around gripping portion 26 and swings the bat approximately one-half of a full swing. Elongated weighted portion 40 initially lags behind elongated gripping portion 20, and then swings forwardly to simulate the impact of an imaginary ball striking elongated gripping portion 20, causing the batter's wrists to snap. An increase in wrist strength is developed to accommodate the initial contact of a ball during actual play.

Figure 5:
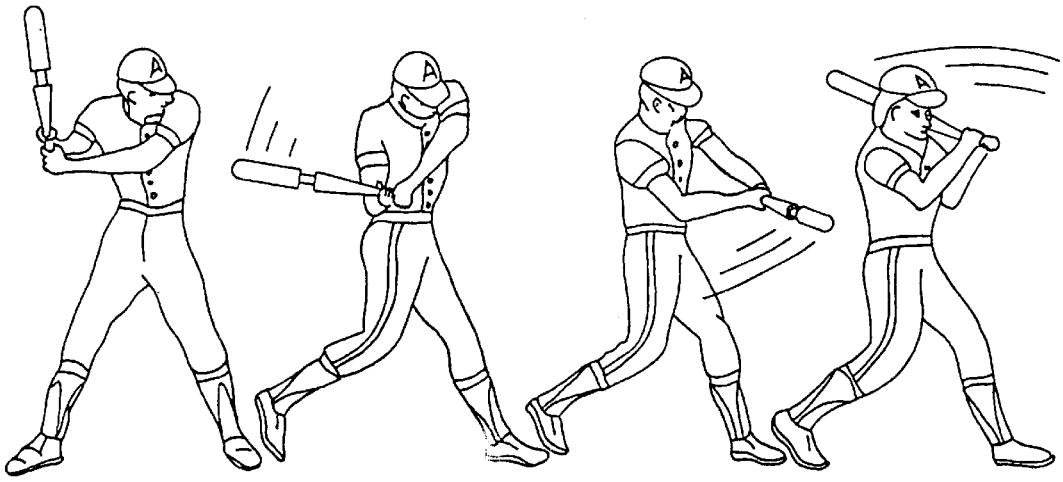
FIG. 5 is a perspective view of the practice bat of FIG. 1 shown in use for studying and increasing bat speed.

As best seen in FIG. 5, to study swing speed, a player grips gripping portion 26 and swings practice bat 10 in a full swing. By reading speed gauge 80, the player determines the swing speed attained for the chosen practice weight. Preferably, a minimal weight is utilized for the initial practice swing. Swing speed is verified and an additional weighted plate 72 is added. The player swings again with the increased weight and again checks his or her attained swing speed, repeating the process until there is a drop off in the swing speed. When maximum performance is achieved and verified, the player is able to ensure that the proper weight bat is purchased and utilized for maximum performance in actual play.

Having thus described exemplary embodiments of the present invention, it should be noted by those skilled in the art that these disclosures are exemplary only, and that various alternatives, adaptations, and modifications may be made within the scope of the present invention. Accordingly, the present invention is not limited to the specific embodiments illustrated herein, but is limited only by the following claims.

Having described our invention, we claim:

1. A practice bat, comprising:

an elongated gripping portion having a first end and a second end;

an elongated weighted portion having a first end and a second end;

a coil spring having a first end and a second end, said first end of said spring being disposed within said first end of said elongated gripping portion;

said second end of said spring being disposed within said second end of said elongated weighted portion;

a first elongated pin extending through said elongated gripping portion at right angles to the length of the elongated gripping portion into said first end of said spring to connect the spring to the elongated gripping portion;

a second elongated pin extending through said elongated weighted portion at right angles to the length of the elongated weighted portion into said second end of said spring to connect the spring to the elongated weighted portion;

a plurality of removable weighted plates which are substantially flat, circular-shaped discs having a substantially circular centrally-positioned hole; and means for mounting a selected number of the removable weighted plates within the first end of the elongated weighted portion, wherein the means for mounting includes an end-cap removably secured to said first end of said elongated weighted portion wherein said end-cap has a threaded inner-surface such that said selected number of weighted plates are removably carried within said elongated weighted portion, and a threaded member axially positioned within said first end of said elongated weighted portion, whereby said selected number of weighted plates are removably positioned around said threaded member and retained thereby, and whereby said end-cap is secured to said threaded member enclosing said plurality of removable weights within said first end of the elongated weighted portion, and further wherein the elongated weighted portion of the bat can swing with respect to the elongated gripping portion as the bat is being swung in a practice batting motion so as to snap a user's wrists.

2. The practice bat of claim 1, wherein said second end of said elongated gripping portion defines a handle.

3. The practice bat of claim 1, wherein said elongated gripping portion carries a grip-enhancing surface.

4. The practice bat of claim 1, wherein the circumference of said elongated gripping portion is maximized adjacent to said first end of the elongated gripping portion, and wherein said circumference is gradually decreased progressing toward said second end of the elongated gripping portion to a handle.

5. The practice bat of claim 1, further comprising a removable cylinder, said cylinder carried by said first end of said second elongated portion.

6. The practice bat of claim 1, further comprising a plurality of elongated fasteners radially extending through said first end of said elongated weighted portion securing positioning of said threaded member therein.

7. The practice bat of claim 1, further comprising a plurality of elongated fasteners radially extending through said first end of said elongated gripping portion, wherein said elongated fasteners secure the position of said spring therein.

8. The practice bat of claim 1, further comprising a readable swing speed gauge within the elongated weighted portion.

* * * * *